US007866399B2

(12) United States Patent
Kozicz et al.

(10) Patent No.: US 7,866,399 B2
(45) Date of Patent: Jan. 11, 2011

(54) APPARATUS AND METHOD FOR MANAGED PRESSURE DRILLING

(75) Inventors: John Kozicz, Spring, TX (US); Tim Juran, Cypress, TX (US); Andy Legault, Houston, TX (US); Sandy Black, Scotland (GB); John Mackay, Scotland (GB); Scott Niven, Scotland (GB); Iain Sneddon, Scotland (GB)

(73) Assignee: Transocean Sedco Forex Ventures Limited, Grand Cayman Islands (KY)

( * ) Notice: Subject to any disclaimer, the term of this patent is extended or adjusted under 35 U.S.C. 154(b) by 461 days.

(21) Appl. No.: 11/584,186

(22) Filed: Oct. 20, 2006

(65) Prior Publication Data

US 2007/0095540 A1 May 3, 2007

Related U.S. Application Data

(60) Provisional application No. 60/728,542, filed on Oct. 20, 2005.

(51) Int. Cl.
*E21B 17/01* (2006.01)

(52) U.S. Cl. ..... 166/367; 166/344; 166/347; 166/369; 166/88.1; 166/89.1; 175/5

(58) Field of Classification Search ..... 166/367, 166/344, 347, 358, 369, 373, 88.1, 89.1; 175/5, 7

See application file for complete search history.

(56) References Cited

U.S. PATENT DOCUMENTS 1,610,372 A 12/1926 Hansen
3,032,125 A * 5/1962 Hiser et al. ..... 175/7
3,191,388 A 6/1965 Ludwig
3,313,345 A 4/1967 Fischer
3,380,520 A 4/1968 Pease
3,434,550 A 3/1969 Townsend
3,791,442 A * 2/1974 Watkins ..... 166/352
3,981,369 A * 9/1976 Bokenkamp ..... 175/5
4,170,266 A 10/1979 Fayren (Continued)

FOREIGN PATENT DOCUMENTS

NO 317295 10/2004

OTHER PUBLICATIONS

Kozicz, J., "Reconfigurable Riser—Enabling Drilling Solutions for the Future", prepared for presentation at the AADE 2005 National Technical Conference and Exhibition, held at the Wyndam Greenspoint in Houston, Texas, Apr. 5-7, 2005; p. 1-11; on-line <http://www.aade.org/TechPapers/2005Papers/Web/Emerging_Technologies/AADE-05-NTCE-23_Kozicz.pdf>.

(Continued)

*Primary Examiner*—Thomas A Beach
*Assistant Examiner*—Matthew R Buck
(74) *Attorney, Agent, or Firm*—Fulbright & Jaworski, LLP

(57) ABSTRACT

A drilling system employing a main tubular having a plurality of fluid inlet and outlet conduits positioned thereon and a concentric inner tubular having a plurality seals for sealing the annular space between the concentric inner and main tubulars. The fluid inlet and outlet conduits work in cooperation with the annular seals to selectively open and close for effective management of pressure within the tubulars.

22 Claims, 9 Drawing Sheets

U.S. PATENT DOCUMENTS 4,176,722 A 12/1979 Wetmore et al.
4,188,156 A 2/1980 Fisher et al.
4,216,834 A * 8/1980 Wardlaw ..... 175/7
4,428,433 A * 1/1984 Watkins ..... 166/339
4,524,832 A * 6/1985 Roche et al. ..... 166/347
4,556,340 A 12/1985 Morton
4,597,447 A * 7/1986 Roche et al. ..... 166/347
4,615,542 A * 10/1986 Ideno et al. ..... 285/11
4,626,135 A 12/1986 Roche
4,653,597 A 3/1987 Johnson
4,668,126 A * 5/1987 Burton ..... 405/169
4,813,495 A 3/1989 Leach
5,314,022 A 5/1994 Cowan et al.
5,513,706 A 5/1996 Jennings, Jr. et al.
5,524,710 A * 6/1996 Shinn ..... 166/348
5,533,574 A * 7/1996 Gonzalez ..... 166/358
5,586,609 A 12/1996 Schuh
5,662,181 A * 9/1997 Williams et al. ..... 175/195
5,720,356 A 2/1998 Gardes
5,873,420 A 2/1999 Gearhart
6,045,296 A * 4/2000 Otten et al. ..... 405/195.1
6,102,673 A 8/2000 Mott et al.
6,138,774 A 10/2000 Bourgoyne, Jr. et al.
6,173,781 B1 * 1/2001 Milne et al. ..... 166/355
6,216,799 B1 4/2001 Gonzalez
6,230,824 B1 5/2001 Peterman et al.
6,263,981 B1 7/2001 Gonzalez
6,263,982 B1 * 7/2001 Hannegan et al. ..... 175/7
6,273,193 B1 * 8/2001 Hermann et al. ..... 166/359
6,276,455 B1 8/2001 Gonzalez
6,308,787 B1 10/2001 Alft
6,315,061 B1 11/2001 Boatman et al.
6,325,159 B1 12/2001 Peterman et al.
6,394,195 B1 5/2002 Schubert et al.
6,401,823 B1 6/2002 Gonzalez et al.
6,415,877 B1 7/2002 Fincher et al.
6,450,262 B1 9/2002 Regan
6,457,529 B2 10/2002 Calder et al.
6,470,975 B1 10/2002 Bourgoyne et al.
6,474,422 B2 11/2002 Schubert et al.
6,499,540 B2 12/2002 Schubert et al.
6,505,691 B2 1/2003 Judge et al.
6,530,437 B2 3/2003 Maurer et al.
6,536,540 B2 3/2003 De Boer
6,579,832 B2 6/2003 Jimenez et al.
6,732,804 B2 5/2004 Hosie et al.
6,739,397 B2 5/2004 Ayling et al.
6,739,408 B2 5/2004 Rowden
6,745,851 B1 6/2004 Edvardsen
6,745,857 B2 6/2004 Gjedebo
6,802,379 B2 10/2004 Dawson et al.
6,843,331 B2 1/2005 De Boer
6,854,532 B2 2/2005 Fincher et al.
6,904,981 B2 6/2005 Van Riet et al.
6,904,982 B2 6/2005 Judge et al.
6,913,092 B2 7/2005 Bourgoyne et al.
6,923,273 B2 8/2005 Terry et al.
6,926,101 B2 8/2005 DeBoer
6,966,392 B2 11/2005 DeBoer
7,027,968 B2 4/2006 Choe et al.
7,032,691 B2 4/2006 Humphreys
7,044,237 B2 5/2006 Leuchtenberg et al.
7,044,343 B2 5/2006 Anue
7,080,685 B2 7/2006 Bailey et al.
7,090,036 B2 8/2006 deBoer
7,093,662 B2 8/2006 deBoer
7,108,066 B2 9/2006 Jamison
7,219,739 B2 * 5/2007 Robichaux ..... 166/355
7,237,613 B2 * 7/2007 Radi et al. ..... 166/359
7,264,058 B2 9/2007 Fossli
7,270,185 B2 9/2007 Fontana et al.
7,303,013 B2 12/2007 Alsobrook et al.
7,306,042 B2 12/2007 Bansal et al.
7,314,087 B2 * 1/2008 Robichaux ..... 166/355
7,334,967 B2 * 2/2008 Blakseth et al. ..... 405/224.2
7,377,323 B2 * 5/2008 Walker et al. ..... 166/348
7,380,609 B2 * 6/2008 Page et al. ..... 166/387
7,395,878 B2 7/2008 Reitsma et al.
7,407,019 B2 8/2008 Kinder et al.
7,482,309 B2 1/2009 Ravi et al.
7,497,266 B2 3/2009 Fossli
7,534,743 B2 5/2009 Kirsner et al.
7,658,228 B2 * 2/2010 Moksvold ..... 166/345
7,699,109 B2 * 4/2010 May et al. ..... 166/367
2001/0050185 A1 * 12/2001 Calder et al. ..... 175/5
2002/0066597 A1 * 6/2002 Schubert et al. ..... 175/38
2003/0070840 A1 * 4/2003 Boer ..... 175/5
2003/0111799 A1 6/2003 Gilmore
2004/0065440 A1 * 4/2004 Farabee et al. ..... 166/358
2005/0061546 A1 3/2005 Hannegan
2005/0284641 A1 12/2005 Watkins et al.
2006/0021755 A1 2/2006 Radi et al.
2006/0065402 A9 3/2006 Fontana et al.
2006/0070772 A1 4/2006 deBoer
2006/0102387 A1 * 5/2006 Bourgoyne et al. ..... 175/5
2007/0151762 A1 7/2007 Reitsma
2007/0284113 A1 * 12/2007 Haheim ..... 166/345
2008/0060846 A1 3/2008 Belcher et al.
2008/0105434 A1 5/2008 Orbell et al.
2009/0090558 A1 4/2009 Polizzotti et al.
2009/0090559 A1 4/2009 Polizzotti et al.

OTHER PUBLICATIONS

International Preliminary Report on Patentability issued Apr. 23, 2008, during the prosecution of International Application No. PCT/US2006/040799. Published Apr. 23, 2008.

International Search Report issued Jul. 16, 2007, during the prosecution of International Application No. PCT/US2006/040799. Published Sep. 20, 2007.

Written Opinion issued Jul. 16, 2007, during the prosecution of International Application No. PCT/US2006/040799. Published Apr. 20, 2008.

Herrmann et al., "Concentric Drilling Risers for Ultra Deepwater," Paper prepared for presentation at the 1998 IADC/SPE Online Conference held in Dallas, TX Mar. 3-6, 1998. Copyright 1996, IAD/SPE Drilling Conference. 11 Pages.

Rike et al., "Recent Innovations in Offshore Completion and Workover Systems," Copyright 1696. Paper prepared for presentation at the First Annual Offshore technology Conference held in Houston, TX, May 18-21, 1969. Paper No. OTC 1020. 14 Pages.

Roger Stave, Technology Development Manager AGR Subea AS, RMR Riserless Mud Return System Dual Gradient System, PowerPoint presentation.

* cited by examiner

APPARATUS AND METHOD FOR MANAGED PRESSURE DRILLING

CROSS-REFERENCE TO RELATED APPLICATIONS

This application is related to provisional Patent Application No. 60/728,542, filed Oct. 20, 2005 entitled "Apparatus and Method for Managed Pressure Drilling."

TECHNICAL FIELD

This invention relates to a novel method and apparatus for offshore drilling operations. In particular, this invention relates to a method and apparatus for employing a concentric, high-pressure marine riser in deep water offshore drilling. In addition, this invention relates to fluid handling in a riser in the event of an unexpected influx of hydrocarbon, fresh water, natural gas, or other pressurized fluid encountered during drilling operations.

BACKGROUND OF THE INVENTION

Presently a number of hydrocarbon drilling techniques have been proposed to better manage pressures within or exerted upon a wellbore during drilling activities. Broadly, these techniques encompass two categories of wellbore pressure control. In the first, a "closed loop" circulating system is employed. This is usually accomplished by installing a rotating control device ("RCD") similar to that described in, Williams et al U.S. Pat. No. 5,662,181. The RCD is positioned on top of a conventional blow-out preventer. In this system, the RCD directs the flow of drilling mud from inside and atop the wellbore so that drilling mud may be monitored and so the pumping rate can be regulated. In the second, various methods of using multiple columns of drilling fluids with different densities to manipulate the drilling fluid pressure gradient within the wellbore or adding a pumping system to boost wellbore fluids from the well. Fluid density levels effect the fluid pressure gradient within the wellbore and help boost fluids from the well.

Due to limitations in the physical characteristics of existing marine risers present pressure management techniques cannot be implemented without substantial additional cost and/or time. For example, the method and apparatus disclosed in U.S. Pat. No. 6,273,193 (Hermann et al) employs a concentric inner riser and related elements (support, sealing mechanisms, etc.). However, the Hermann et al method and apparatus require the marine riser system to be substantially disassembled before the concentric riser can be deployed. Disassembling the marine riser system adds significant time and cost to the drilling operation. Additionally, the system of Hermann et al leaves the upper end of the marine riser system unpinned to the underside of the rig. This results in the potential for differential movement of the riser away from the well centerline that could cause eccentric side loading of wellbore annular sealing element. Further, the Hermann et al method employs the upper annular blow-out preventer of the existing BOP to effectively seal and isolate the annulus between the lower end of the concentric riser and the lower end of the marine riser rendering it unavailable for its primary well control function.

Hannegan et al. U.S. Pat. No. 6,263,982 describe a method and apparatus where a RCD is installed on top of a marine riser in a manner similar to Hermann et al method and apparatus. The Hannegan method and apparatus has similar limitations with respect to the time and cost of installing and operating the system. Additionally, without an concentric riser, the burst pressure capacity of the conventional marine riser limits the maximum annular pressure that may be imposed.

The present invention overcomes these limitations by enabling a conventional marine riser that is easily configured and reconfigured to conduct dual gradient and annular drilling capabilities.

BRIEF SUMMARY OF THE INVENTION

The present invention is directed to a drilling system and method that manages pressure within a riser during drilling operations. Specifically, the drilling system employs a main marine riser having a plurality of fluid inlet and outlet conduits, concentric inner riser supported within the main marine riser, a riser rotating control device, and a plurality of annular seals disposed within the annular space between the main marine riser and concentric inner riser. These elements work in cooperation to manage the fluid density in the riser and to control influxes of abnormally pressurized fluids into the risers. The present invention provides an efficient method of preventing blowouts and other potentially disastrous consequences of drilling though formations with water, natural gas, pockets of frozen methane gas, or other underground fluid reservoirs.

A preferred embodiment of the inventive pressure management system is a concentric riser support body that includes a tubular body, a riser annular seal within the tubular body that is configured to sealingly engage a concentric tubular member when the seal is actuated, a concentric riser annular seal within the tubular body below the riser annular seal that is configured to sealingly engage a concentric riser member when actuated, and a concentric riser support within the tubular body below the concentric riser annular seal that is configured to supportingly engage a concentric riser member. The pressure management system may further include a tubular body with a concentric riser fluid inlet above the concentric riser annular seal and a concentric riser annular fluid inlet below the concentric riser annular seal.

The tubular body of the support body may include a concentric riser fluid outlet above the concentric riser annular fluid inlet. The fluid inlets and outlet may be opened, closed, or partially opened. Further, the inlets and outlets may include at least one flow meter.

The concentric riser support body of the preferred embodiment may also include a bottom that is configured to mate with a marine riser pipe and a top that is configured to mate with a telescopic joint, or combinations thereof. The support body may also include a plurality of concentric riser fluid conduits below the riser annular seal, which conduits may include valves that may me independently controlled or controlled as a single value, or combinations thereof. The fluid conduits may also be configured as fluid inlets and fluid outlets.

A preferred embodiment of the pressure management system includes a riser, a riser support connected to the riser, a telescopic joint connected to the riser, a concentric riser support body between the riser telescopic joint and the riser support, and a concentric riser inside the riser and the concentric riser support body. The concentric riser may be sized to create an annular space between the concentric riser and the riser. The concentric riser annular seal may be configured to sealingly engage the concentric riser when the seal is actuated. The concentric riser annular seal is designed to prevent fluid in the annular space between the riser and the concentric riser from flowing past the concentric riser annular seal when the seal is actuated.

The concentric riser system may also include a riser rotating control device positioned within the riser and above the concentric riser. The riser rotating control device may include a riser rotating control device pipe section (sized to create an annular space between the riser rotating control device pipe section and the riser) and a riser rotating control device seal operably positioned within and/or exterior to the riser rotating control device pipe section.

The preferred concentric riser system may also include a concentric riser support body that includes a riser annular seal that is designed to sealingly engage the riser rotating control device pipe section when the seal is actuated. The concentric riser support body may also include a plurality of concentric riser fluid channels and a concentric riser annular channel spaced below the plurality of concentric riser fluid channels.

The concentric riser system may also include flow sensing equipment connected to at least one of the plurality of concentric riser fluid channels. The flow sensing equipment may be configured to measure flow volume and pressure inside the at least one of the plurality of concentric riser fluid channels. The concentric riser system may also include a lower concentric riser annular seal positioned inside the riser and adapted to sealingly engage the concentric riser when actuated. The lower concentric riser annular seal is positioned in close proximity to the bottom of the concentric riser.

In addition to structural embodiments, the invention includes a preferred method of managing pressure and/or riser fluid density. The preferred method includes injecting a fluid of a first density through a drill pipe, injecting a fluid of a second density through an annular space between a riser and a concentric riser, mixing the two fluids below the concentric riser, and returning the mixed density fluid toward the top of the riser in the annular space between the drill pipe and concentric riser.

The method may further include the step of retrieving the mixed density fluid through a port in fluid communication with the top of the concentric riser. The method may also include the step of measuring relevant fluid flow parameters of the mixed density fluid as it is retrieved from the port in fluid communication with the top of the concentric riser. The method may also include the steps of measuring relevant fluid flow parameters of the fluid of the first density, measuring relevant fluid flow parameters of the fluid of the second density, and comparing the parameters of the fluids of the first and second density with the mixed density fluid. Additionally, the comparison may result in controlling a blow out preventer in response to the step of comparing the fluids. Control may include changing the second density responsive to well parameters. The preferred method may also include sealing the annular space between a riser and riser rotating device before the step of injecting the fluid of the second density.

Another preferred embodiment is a drilling system that includes a drilling platform, a main drilling riser connected to the drilling platform, where the main drilling riser includes a plurality of lengths of riser tubulars coupled at generally opposed ends, a blow-out preventer connected to the main drilling riser, a concentric riser within the main drilling riser, where the concentric inner riser comprises a plurality of lengths of riser tubulars coupled at generally opposed ends, and one or more annular seals connected to the main drilling riser, wherein the annular seals are configured to isolate pressure in the annular space between the main and concentric riser and below the annual seal.

The drilling system may also include one or more riser fluid inlet conduits connected to the main riser, wherein the riser fluid inlet conduit is configured to receive fluid. The drilling system may also include one or more riser fluid outlet conduits connected to the main riser, wherein the riser fluid outlet conduit is configured to discharge fluid.

The concentric riser of the drilling system may be configured to receive fluid from a drill pipe and discharge the fluid to a drilling fluid processor. At least one of the annular seals of the drilling system may measure the pressure in the annular space between the main riser and the concentric riser and below the annular seal. The annular seals may be configured to open and close in the event of fluid influx into the main riser or the concentric riser so that pressure within the risers is controlled. The riser fluid inlet conduit may be configured to introduce fluid into the annular space between the main riser and the concentric riser, and wherein the concentric riser is configured to receive fluid from the annular space between the main riser and the concentric riser and discharge fluid to the fluid processing equipment.

The drilling system may also include a riser fluid inlet conduit that is configured to introduce fluid into the annular space between the main and concentric riser, and wherein the concentric riser is configured to receive fluid from the annular space between the main riser and the concentric inner riser, and wherein a riser rotating seal is configured to close so that fluid is discharged through the one or more fluid outlet conduits.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1:
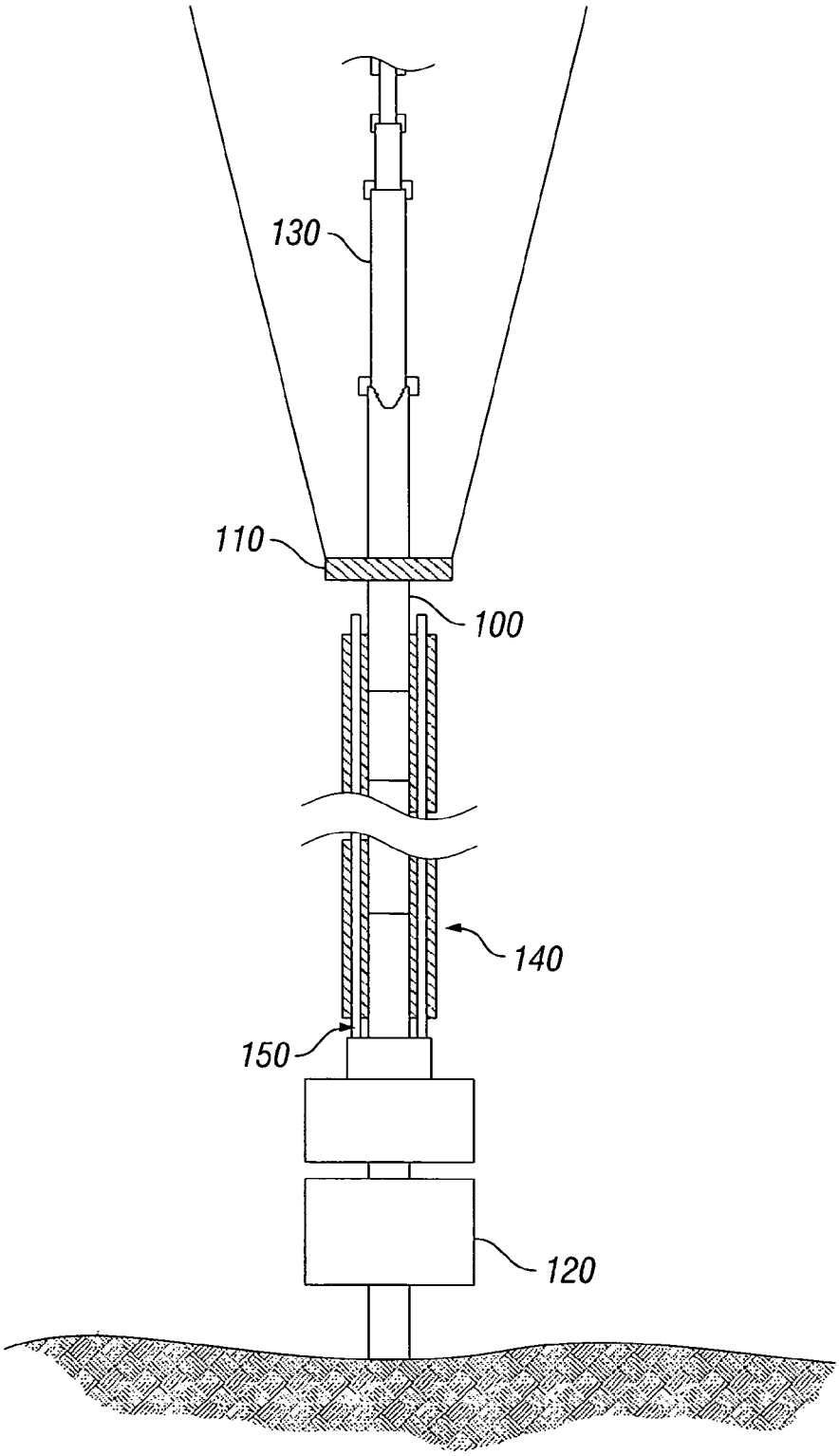
FIG. 1 (Prior Art)
FIG. 1 shows a conventional riser drilling system.

FIG. 1 shows a conventional riser drilling system. A conventional riser system includes marine riser (100), riser tensioning system (110), blowout preventer (120), telescopic joint (130), auxiliary buoyancy (140) and auxiliary lines (150).

Figure 2:
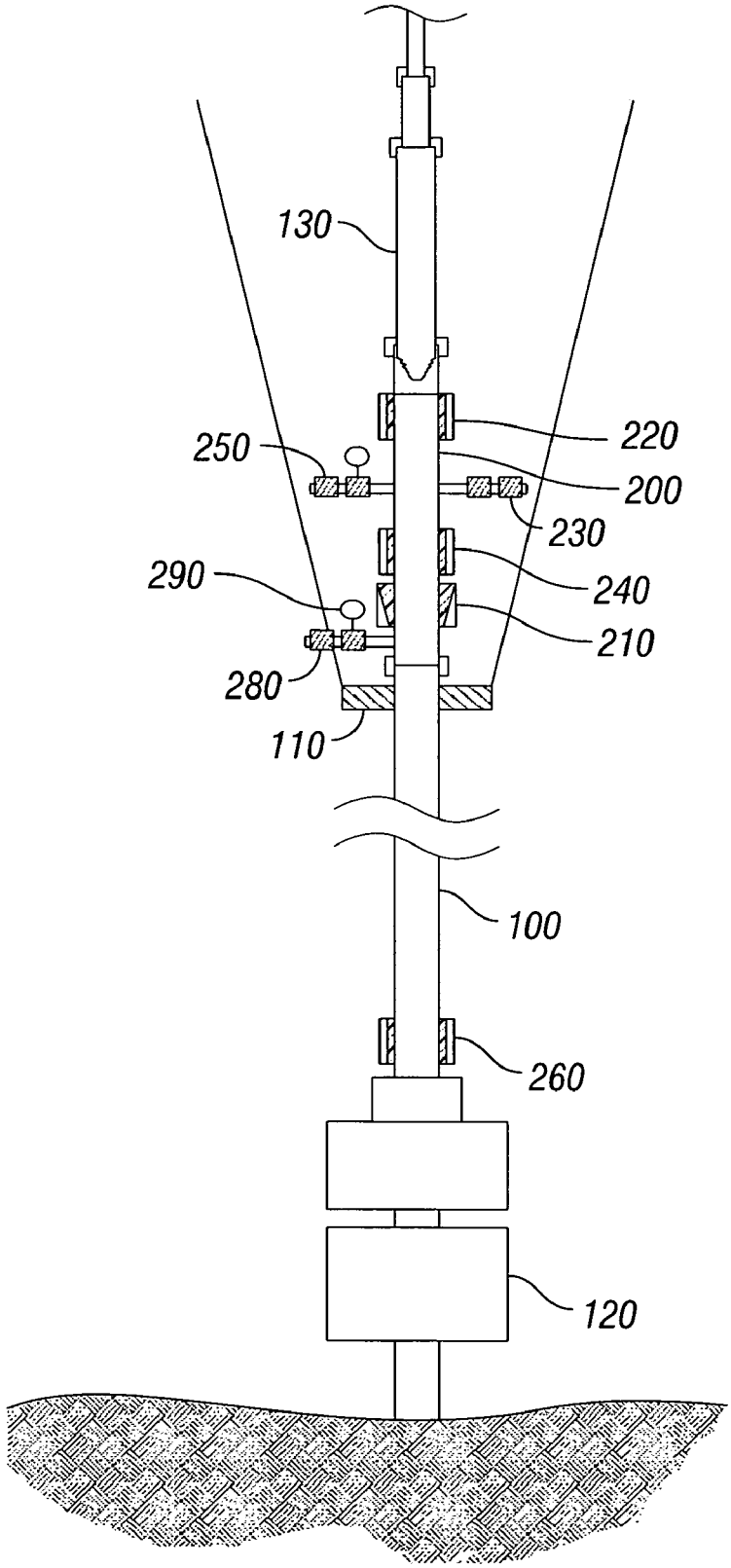
FIG. 2 shows a concentric riser support body installed on a marine riser.

FIG. 2 shows a preferred embodiment of the invention. Specifically, FIG. 2 shows a marine riser (100) and a riser telescopic joint (130). A riser tensioning system (110) supports and maintains a constant tension on marine riser (100). The bottom of marine riser (100) is connected to a sub-sea blowout preventer (120). Sub-sea blowout preventer (120) is connected to a wellhead (not shown). Positioned above riser tensioning system (110) is the concentric riser support body (200). Concentric riser support body (200) mates with marine riser (100) and telescopic joint (130). Although FIG. 2 does not show any marine riser joints above concentric riser support body (200), one skilled in the art readily understands that such an arrangement is possible. Of importance, however, is the relationship between concentric riser support body (200) and riser tensioning system (110). In the preferred embodiment, concentric riser support body (200) is positioned above riser tensioning system (110). Although a preferred embodiment includes concentric riser support body (200), components of the invention may be incorporated directly into one or more riser tubular members. In this configuration, the system may retain the functionality disclosed herein without a concentric riser support body (200).

Concentric riser support body (200) also includes a concentric riser support (210). Concentric riser support (210) positions and supports concentric riser (300) (FIG. 3) within marine riser (100).

Concentric riser support body (200) also includes riser annular seal (220). Riser annular seal (220) is located above the top of concentric riser (300) (See FIGS. 3 and 4). In a preferred embodiment, riser annular seal (220) is located above the top of concentric riser (300) and concentric riser fluid outlet (230) and adjacent to a portion of the riser rotating control device (310) (See FIGS. 3 and 4). The riser annular seal (220) may be opened, closed, or partially opened.

Concentric riser support body (200) also includes concentric riser annular seal (240). Concentric riser annular seal (240) is located below the top of concentric riser (300). In a preferred embodiment, concentric riser annular seal (240) is located below concentric riser fluid inlet (250), outlet (230), and the bottom of riser rotating control device (310). Concentric riser annular seal (240) may be opened, closed, or partially opened.

Figure 4:
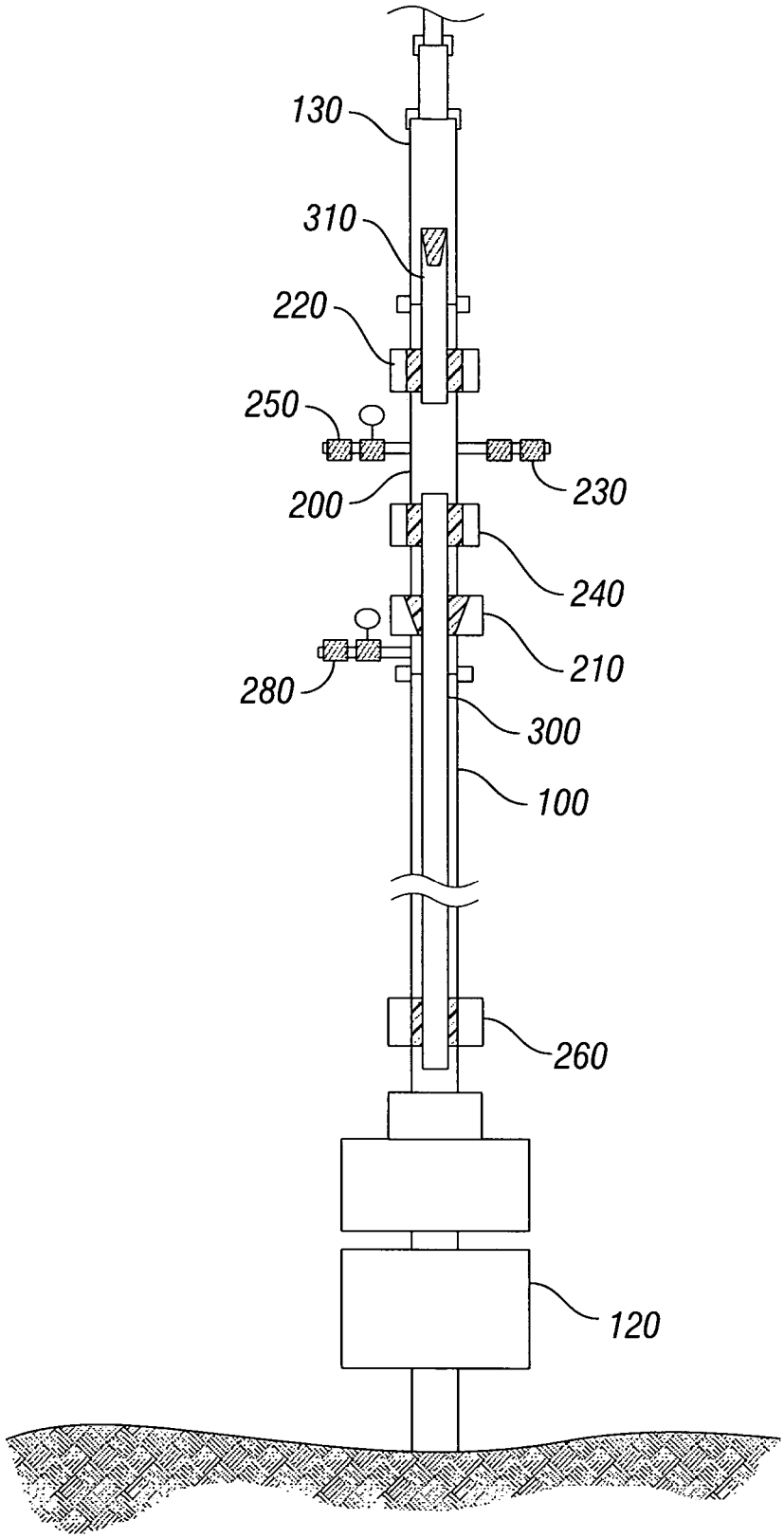
FIG. 4 shows a concentric riser support body supporting a concentric riser and a riser rotating device.
Figure 7:
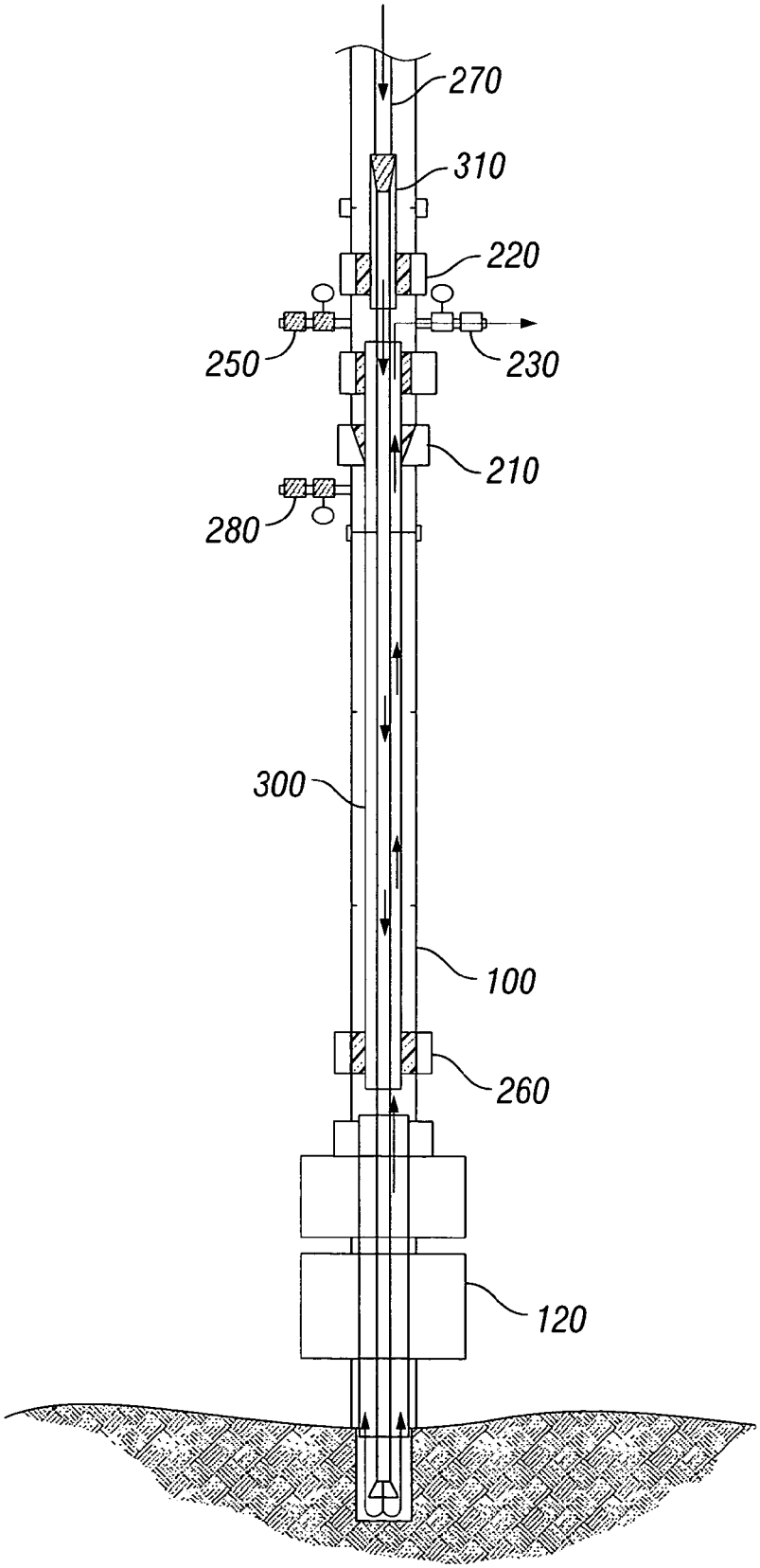
FIG. 7 shows a concentric riser drilling system operating in a closed loop annular pressure management mode.

A concentric riser drilling system may also include a lower concentric riser seal (260). In a preferred embodiment, lower concentric riser seal (260) is positioned adjacent to bottom of concentric riser (300) (FIG. 4). Lower concentric riser seal (260) may be opened, closed, or partially opened. In operation, concentric riser annular seal (240) and lower concentric riser seal (260) can be closed to isolate marine riser (100) from high pressure fluid in drill string (270) (FIG. 7).

The seals and concentric riser support (210) are shown outside of the marine riser for clarity. One skilled in the art knows the seals and support are inside the marine rise. Additionally, the seals and the support are described as single components, however, one skilled in the art understands these components may actually be one or more. For example, there may be two or more riser annular seals (220). Further, some of the components may not be separate components as described, but may be combined into single units. For example, concentric riser annular seal (240) and concentric riser support (210) may be combined into one unit that performs both functions.

Concentric riser support body (200) may also include a fluid service assembly (not shown) that supplies fluids such as lubrication, cooling and control fluids to riser rotating control device (310). The fluid service assembly is preferably positioned adjacent to riser rotating control device (310).

Figure 3:
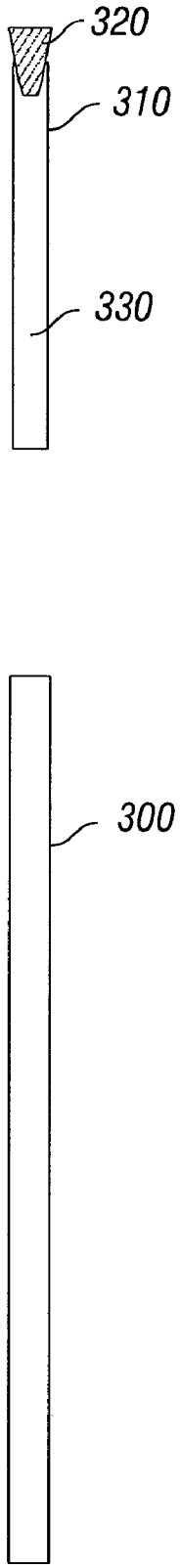
FIG. 3 shows a concentric riser and a riser rotating control device.

Concentric riser support body (200) also includes a concentric riser fluid inlet (250) and a concentric riser fluid outlet (230). As will be explained with reference to FIG. 4, concentric riser fluid inlet (250) and outlet (230) are configured to be in a cooperative relationship with riser rotating control device (310) (FIG. 3). Additionally, concentric riser support body (200) includes an annular fluid inlet (280). Although single inlets and outlets are shown, one skilled in the art readily understands the number of inlets and outlets can be varied. For example, in some systems it might be advantageous to have two or more concentric riser fluid inlets (250). Inlets and outlets accessing the same annular space are generally interchangeable. For example, fluid could flow into the system through the concentric riser fluid outlet (230).

The inlets and outlets include valves that can be opened, closed, or partially opened. In most applications, the valves are either open or closed. Additionally, inlets are shown with gauges (290). Although gauges are only shown in conjunction with inlets, one skilled in the art readily understands gauges can be used with both inlets and outlets.

FIG. 3 shows concentric riser (300) and riser rotating control device (310). Concentric riser (300) is preferably a string of high-pressure tubular members configured to be run concentrically inside of marine riser (100) (FIG. 4). In a preferred embodiment, concentric riser (300) is connected at a lower end with an internal tieback hanger (not shown) and lower concentric riser annular seal (260). When actuated, lower concentric riser seal (260) prevents fluid from circulating above lower concentric riser annular seal (260) in the annular space between marine riser (100) and concentric riser (300). In a preferred embodiment, concentric riser (300) is sized to be deployed within a twenty-one inch marine riser (100).

FIG. 3 also shows the riser rotating control device (330). In a preferred embodiment riser rotating control device (330) is positioned within the marine riser (100) and telescoping joint (130), above the concentric riser (300).

Riser rotating control device (310) includes RCD seal (320) and RCD pipe section (330). RCD pipe section (330) is optionally sized to be sealingly engaged by riser annular seal (220). In one embodiment, RCD pipe section (330) is the same size as concentric riser (300). When closed, RCD seal (320) prevents fluid from flowing between RCD pipe section (330) and drill pipe (270). When rotating control device (310) is closed, return fluids can be drawn out of marine riser (100) through concentric riser fluid outlet (230) (FIG. 7). Concentric riser fluid outlet (230) is configured to draw gas out of marine riser (100) and into the atmosphere or the rig's choke manifold where the fluid can be processed by burner booms, ventilation lines or other drilling processing equipment (not shown). It should be noted that rotating control device (310) can installed and actuated within a very short period of time. The concentric riser fluid outlets (230) may also be opened and closed within a short period of time. Rapidly actuating rotating control device (310) and opening and closing the concentric riser fluid outlets (230) enables an operator to quickly control and management bottom hole pressures.

FIG. 4 shows a preferred embodiment with the relative placement of the concentric riser support body (200) relative to concentric riser (300) and riser rotating control device (310). Although not shown, a fluid service assembly is preferably coupled to rotating control device (310) and riser annular seal (220). In this arrangement, fluids can be supplied through the fluid service assembly (not shown) to the rotating control device (310) as needed for operation of the rotating control device (310).

In operation, the concentric riser support body (200) is preferably installed while installing marine riser (100). Once marine riser (100) is in place (including concentric riser support body (200)), it can be operated as a conventional riser system. For operations in which the operator wishes to use the pressure management system disclosed herein, concentric riser (300) is assembled and lowered into marine riser (100). The length of concentric riser used depends on the length of riser. Concentric riser (300) should extend above concentric riser annular seal (240) and below lower concentric riser seal (260). The bottom of concentric riser should terminate above BOP (120).

Riser rotating control device (310) is installed within the upper body of concentric riser support body (200). Riser rotating control device (310) should be installed such that RCD seal (320) is positioned above riser annular seal (220) and the RCD pipe section (330) extends far enough into marine riser (100) to be engaged by riser annular seal (220). In a typical installation, the bottom of RCD pipe section (330) extends below riser annular seal (220).

It should be noted the riser tensioning system (110) is not shown in FIGS. 4 through 9 for clarity purposes. However, a preferred embodiment includes the riser tensioning system (110) as described above and in FIG. 2.

Figure 5:
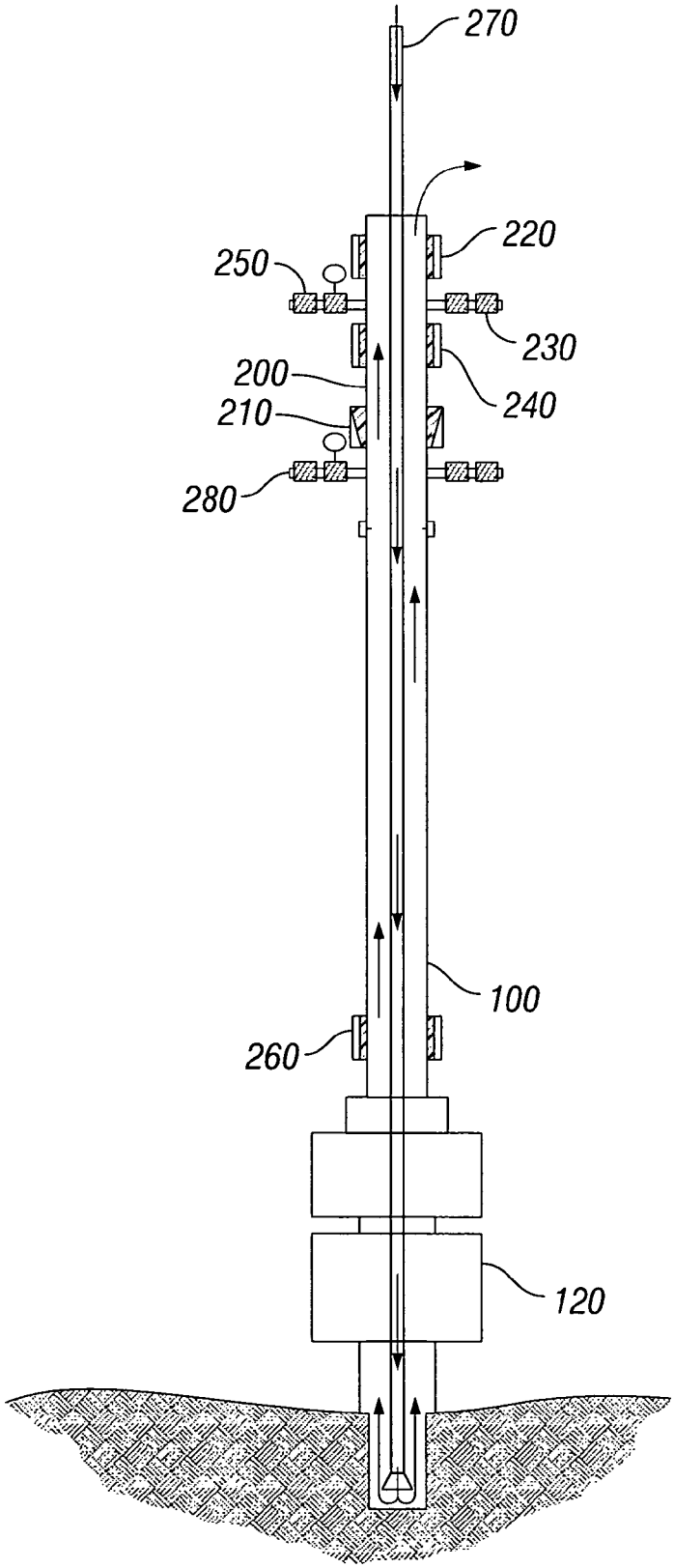
FIG. 5 shows a concentric riser drilling system operating in a conventional open loop annular pressure management mode.

FIG. 5 shows the concentric riser drilling system in open loop operating mode with components above the concentric riser support body (200) removed for clarity. Concentric riser support body (200) is shown with unactuated (open) seals (220, 240, and 260), closed concentric riser fluid inlet (250), closed concentric riser fluid outlet (230), and unused concentric riser support (210). In this configuration, drilling fluid is pumped through drill pipe (270) with fluid pumping equipment (not shown). The fluid travels down drill pipe (270), through drill bit (not shown), and up the annulus between drill pipe (270) and marine riser (100). Drilling fluid processing equipment (not shown) receives return fluid from the top of the marine riser (100).

Figure 6:
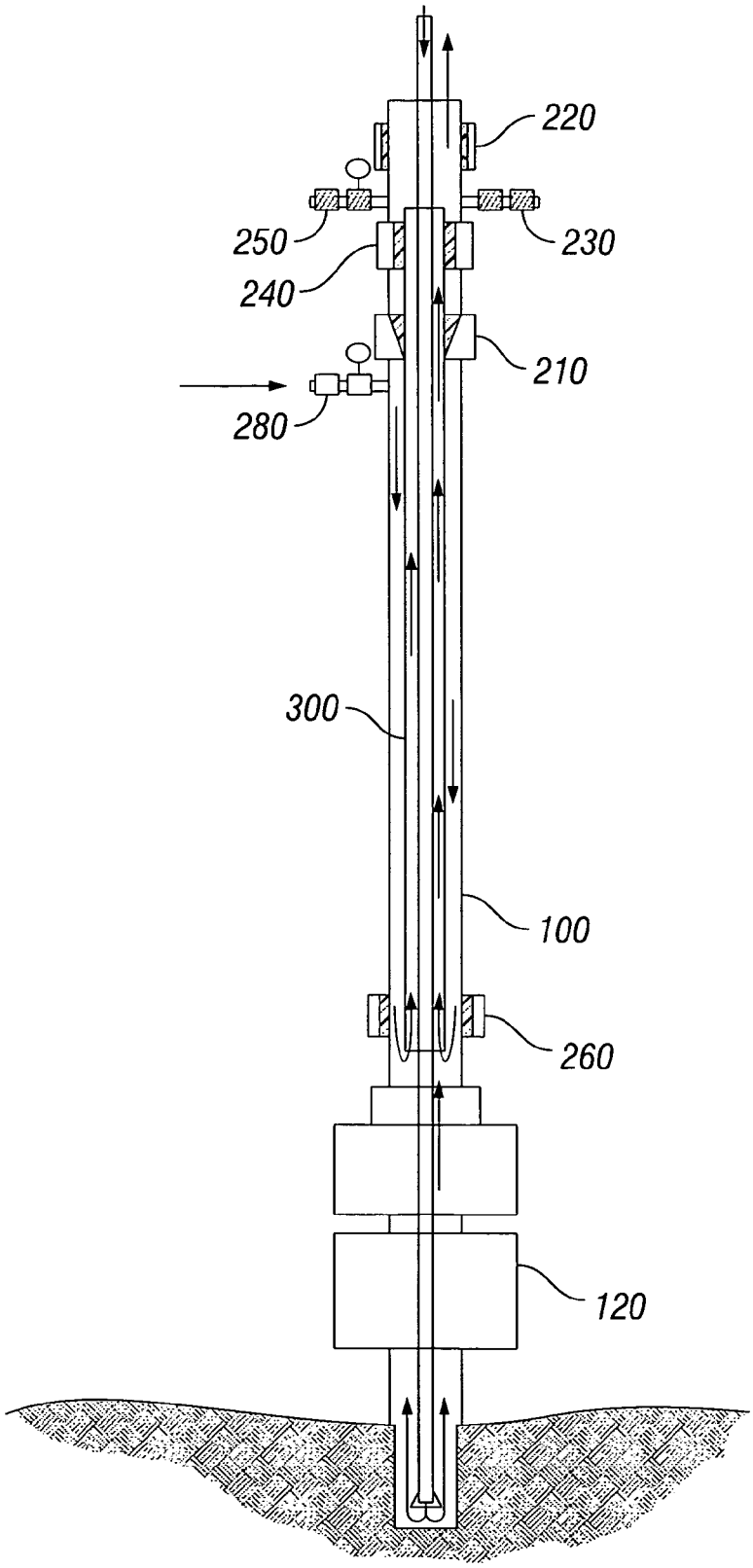
FIG. 6 shows a concentric riser drilling system operating in an open loop dual gradient mode.

FIG. 6 shows the concentric riser system in open loop dual gradient drilling mode. In this embodiment, concentric riser (300) is installed within marine riser (100). Concentric riser annular seal (240) is actuated so that drilling fluid cannot flow to the surface in the annulus between the marine riser (100) and concentric riser (300). Concentric riser support body (200) is shown with unactuated riser annular seal (220) and without the riser rotating control device (310). Although riser rotating control device (310) is not shown in FIG. 6, it may be installed—or if installed does not have to be removed—to operate in open loop dual gradient drilling mode. If installed, riser annular seal (220) and RCD seal (320) are not actuated. Fluid can flow past unactuated riser annular seal (220) and/or unactuated RCD seal (320) and out the top of marine riser (100).

This open loop dual gradient arrangement, enables drilling fluid to be injected though the concentric riser annular fluid inlet (280) into the annulus between marine riser (100) and concentric riser (300). In a dual gradient mode, the fluid injected though the concentric riser annular fluid inlet (280) is a different density (weight) than the fluid circulated down through drill sting (270). As drilling fluid from the concentric riser annular fluid inlet (280) reaches the bottom of concentric riser (300), it mixes with the fluid circulated through drill pipe (270). The mixed fluids are then circulated up the annulus between drill string (270) and concentric riser (300). The direction of fluid flow is shown with arrows.

This configuration has a number of advantages over previously proposed equipment configurations that employ fluid dilution based dual gradient drilling. For example, injecting the diluting fluid into the annular space between concentric riser (300) and marine riser (100) mitigate injection pressure and enable smaller less powerful mud pumps than would otherwise be required to overcome friction losses if the diluting fluid was injected into the bottom of the riser via an auxiliary riser boost line (not shown). Furthermore, this configuration has the additional benefit of reducing the total system volume of diluting fluid required to achieve the desired dual gradient riser mud weight which further reduces the need for large storage tanks and other surface equipment.

The embodiment shown in FIG. 6 is particularly effective in larger wellbore sections where typically high mud flow rates are required to maintain sufficient annular velocity to clean cuttings from the wellbore. While circulating rates for conventional open loop dual gradient systems are approximately 1200 gallons per minute ("gpm"), those of the embodiment shown in FIG. 5 are much greater. For example, using a 2 to 1 dilution rate to achieve a given dual gradient mud weight and a typical twenty-one inch diameter marine riser, the combined dilution and wellbore fluid return rates may be as high as 3600 gpm. Thus, this embodiment provides significantly improved return rates over presently known dual gradient techniques.

FIG. 7 shows the concentric riser drilling system configured for annular pressure management mode. In annular pressure management mode, riser rotating control device (310) and riser annular seal (220) are closed. Fluid is pumped down through drill pipe (270) and out of the concentric riser fluid outlet (230). In the embodiment shown, annular seals (240) and (260) are closed. This isolates the annular space between the marine riser (100) and concentric risers (300). Alternatively, if fluid pressure on marine riser (100) is not an issue, seals (240) and (260) may remain open.

Fluid forced out concentric riser fluid outlet (230) is evaluated for information relevant to the drilling operation. For example, comparing the fluid pumped into the well bore with the fluid pumped out concentric riser fluid outlet (230) will tell an operator whether fluid from the formation is seeping into the wellbore or whether drilling fluid is penetrating into the well bore. Of particular interest is fluid pressure information. Pressure increases can alert an operator to potential dangerous pressure kicks.

Figure 8:
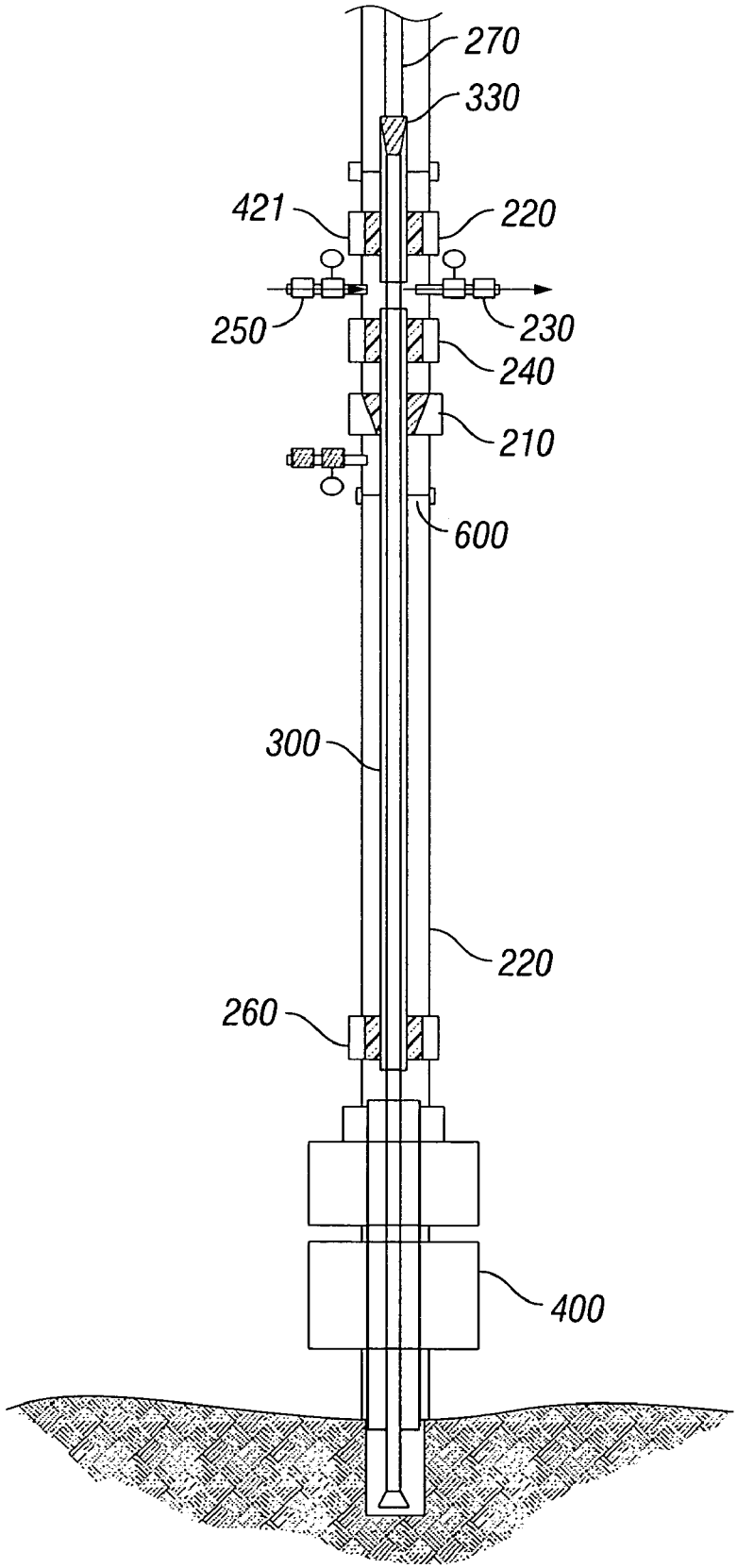
FIG. 8 shows a concentric riser drilling system operating in closed loop annular pressure management mode.

FIG. 8 shows the concentric riser drilling system operating in annular pressure connection mode. This mode is preferably employed to maintain a controlled bottom hole pressure while conventional circulation through drill string (270) has stopped.

In this mode, the marine riser (100) receives fluid though the concentric riser fluid inlet (250) and discharges the fluid out of concentric riser fluid outlet (230). Accordingly, the fluid inlet (250) and outlet (230) are open, and annular seals (220), (240), and (260) are closed. This configuration isolates the annular space between the marine riser (100) and concentric riser (300) between seals (240) and (260). Fluid discharged through concentric riser fluid outlet (230) may be analyzed as described with respect to FIG. 7.

Although not shown in FIG. 8, the annular pressure connection mode may also be employed without the concentric riser (300). This configuration isolates the annular space between the marine riser (100) and drill pipe (270) between seals (240) and (260). The marine riser (100) is configured to receive fluid though the concentric riser fluid inlet (250) and discharge the fluid out of concentric riser fluid outlet (230). Accordingly, the fluid inlet (250) and outlet (230) are open, and annular seals (220), (240), and (260) are closed. The return fluid may from the main riser (100) is then optionally directed to a flow metering device, or choke manifold (not shown).

Figure 9:
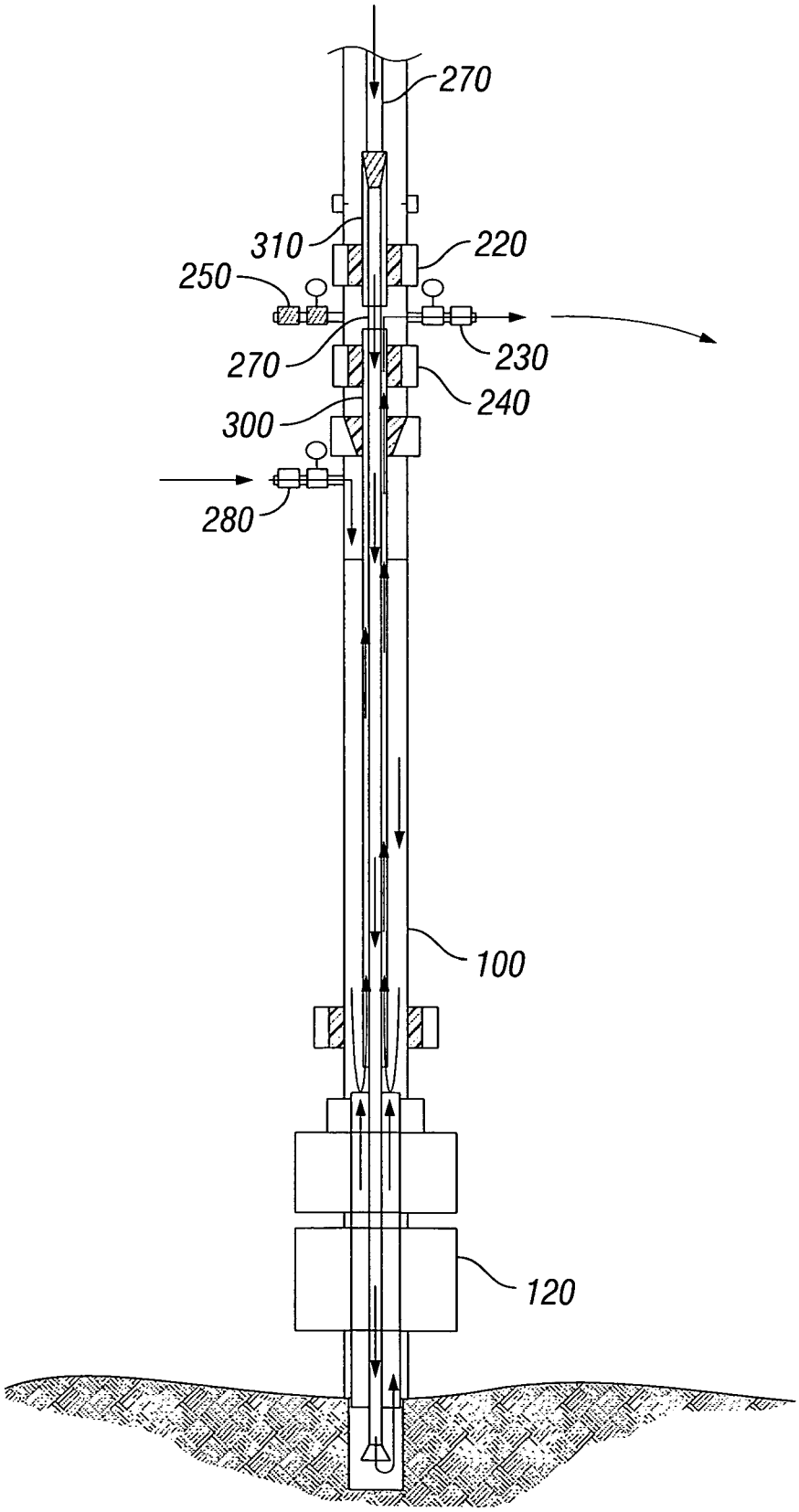
FIG. 9 shows a concentric riser drilling system operating in closed loop dual gradient annular pressure mode.

FIG. 9 shows the concentric riser drilling system operating in dual gradient and annular pressure management mode. Fluid is received into both the annulus between the marine riser (100) and concentric riser (300) and drill pipe (270) as described with respect to FIG. 6. The annulus between concentric riser (300) and drill pipe (220) receives the mixed fluids and circulates it upward to concentric riser fluid outlet (230). Fluid discharged through concentric riser fluid outlet (230) is analyzed as described with respect to FIG. 7.

This combination of dual gradient and annular methods presents a number of advantages. First, it provides a closed loop circulating system. Thus, return flow may be precisely measured and controlled. Second, drilling operators may establish and vary a dual gradient to better match the naturally occurring wellbore pressure profile.

Gas permeability ($N_2$, produced gas) of the blowout preventer and riser elastomer elements is important. Accordingly, a preferred embodiment includes elastomer/rubber components not susceptible to failure caused by aerated drilling fluid or gases produced by a sudden pressure drop. Such elastomer/rubber components include, for example, blowout preventer ram sealing elements, blowout preventer bonnet seals, and flex joint elastomer elements.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A concentric riser support body comprising, a tubular body positionable entirely above a riser tensioning ring, said tubular body including a concentric riser fluid inlet and a concentric riser annular fluid inlet;

a riser annular seal within said tubular body configured to sealingly engage a concentric tubular member when actuated;

a concentric riser annular seal within said tubular body below said riser annular seal and said concentric riser fluid inlet and above said concentric riser annular fluid inlet configured to sealingly engage a concentric riser member when actuated; and a concentric riser support within said tubular body below said riser annular seal.

2. The concentric riser support body of claim 1, wherein said tubular body includes a concentric riser fluid outlet above said concentric riser annular fluid inlet.

3. The concentric riser support body of claim 2, wherein said concentric riser fluid inlet, said concentric riser fluid outlet, and said concentric riser annular fluid inlet have valves that can be opened and closed.

4. The concentric riser support body of claim 3, wherein said concentric riser fluid inlet, said concentric riser fluid outlet, and said concentric riser annular fluid inlet have flow meters.

5. The concentric riser support body of claim 4, wherein the bottom of said tubular body is configured to mate with a marine riser pipe.

6. The concentric riser support body of claim 5, wherein the top of said tubular body is configured to mate with a telescopic joint.

7. A concentric riser system comprising, a riser;

a riser support connected to said riser;

a telescopic joint connected to said riser and positioned above said riser support;

a concentric riser support body between said riser telescopic joint and said riser support wherein said concentric riser support body comprises a plurality of concentric riser fluid channels and a concentric riser annular channel spaced below said plurality of concentric riser fluid channels, and;

a concentric riser inside said riser and said concentric riser support body.

8. The concentric riser system of claim 7, wherein said concentric riser is sized to create an annular space between said concentric riser and said riser.

9. The concentric riser system of claim 8, wherein said concentric riser support body comprises a concentric riser annular seal that sealingly engages said concentric riser when actuated.

10. The concentric riser system of claim 9, wherein said concentric riser annular seal prevents fluid in the annular space between said riser and said concentric riser from flowing past said concentric riser annular seal when actuated.

11. The concentric riser system of claim 7, further comprising a riser rotating control device within said riser and above said concentric riser.

12. The concentric riser system of claim 11, wherein said riser rotating control device comprises a riser rotating control device pipe section and a riser rotating control device seal within said riser rotating control device pipe section.

13. The concentric riser system of claim 12, wherein said riser rotating control device pipe section is sized to create an annular space between said riser rotating control device pipe section and said riser.

14. The concentric riser system of claim 13, wherein said concentric riser support body comprises a riser annular seal that sealingly engages said riser rotating control device pipe section when actuated.

15. The concentric riser system of claim 14, wherein said riser annular seal prevents fluid in the annular space between said riser and said riser rotating control device pipe section from flowing past said riser annular seal when actuated.

16. The concentric riser system of claim 7, further comprising flow sensing equipment connected to at least one of said plurality of concentric riser fluid channels.

17. The concentric riser system of claim 16, wherein said flow sensing equipment measures flow volume and pressure inside the at least one of said plurality of concentric riser fluid channels.

18. The concentric riser system of claim 11, further comprising a lower concentric riser annular seal positioned inside said riser and adapted to sealingly engage said concentric riser when actuated.

19. The concentric system of claim 18, wherein said lower concentric riser annular seal is positioned in close proximity to the bottom of said concentric riser.

20. A drilling system comprising:

a drilling platform;

a main drilling riser connected to said drilling platform; wherein said main drilling riser comprises a plurality of lengths of riser tubulars coupled at generally opposed ends;

a riser tensioning ring connected to said main drilling riser;

a blow-out preventor connected to said main drilling riser;

a riser annular seal within said main drilling riser above said riser tensioning ring, wherein said riser annular seal is configured to isolate pressure within said main drilling riser and below said riser annular seal;

a concentric riser annular seal within the main drilling riser above said riser tensioning ring, wherein said concentric riser annular seal is configured to isolate pressure within said main riser;

one or more riser fluid inlet and outlet conduits connected to said main drilling riser, wherein said one or more riser fluid inlet and outlet conduits is configured to receive and discharge fluid;

a concentric riser within said main drilling riser, wherein said concentric inner riser comprises a plurality of lengths of riser tubulars coupled at generally opposed ends; and a drilling fluid processor and a drill pipe, wherein said drilling fluid processor is adapted to receive fluid from said concentric inner riser and said concentric inner riser is configured to receive fluid from said drill pipe.

21. The drilling system of claim 20, wherein said riser fluid inlet conduit is configured to introduce fluid into an annular space between said main drilling riser and said concentric riser, and wherein said concentric riser is configured to receive fluid from an annular space between said main drilling riser and said concentric riser and discharge fluid to said fluid processing equipment.

22. The drilling system of claim 21, wherein said riser fluid inlet conduit is configured to introduce fluid into the annular space between said main drilling riser and said concentric riser, and wherein said concentric riser is configured to receive fluid from the annular space between said main drilling riser and said concentric inner riser, and wherein a riser rotating seal is configured to close so that fluid is discharged through said one or more fluid outlet conduits to said drilling fluid processor.

* * * * *